US009000742B2

(12) United States Patent
Chen et al.

(10) Patent No.: US 9,000,742 B2
(45) Date of Patent: Apr. 7, 2015

(54) SIGNAL GENERATING CIRCUIT

(75) Inventors: Xi Chen, Beijing (CN); Chien-Wei Kuan, Hsinchu (TW)

(73) Assignee: MediaTek Singapore Pte. Ltd., Singapore (SG)

( * ) Notice: Subject to any disclaimer, the term of this patent is extended or adjusted under 35 U.S.C. 154(b) by 0 days.

(21) Appl. No.: 13/612,884

(22) Filed: Sep. 13, 2012

(65) Prior Publication Data

US 2013/0113454 A1 May 9, 2013

(30) Foreign Application Priority Data

Nov. 7, 2011 (CN) ..... 2011 1 0348487

(51) Int. Cl.
*G05F 1/565* (2006.01)
*G05F 1/56* (2006.01)
*G05F 1/575* (2006.01)

(52) U.S. Cl.
CPC *G05F 1/56* (2013.01); *G05F 1/575* (2013.01); *Y10S 323/901* (2013.01)

(58) Field of Classification Search
CPC ..... H02M 3/156; H02M 3/157; H02M 3/158; H02M 3/1584; H02M 3/1588; H02M 2001/0009; H02M 2001/0012; H02M 2001/0032; G05F 3/24; G05F 3/30; G05F 3/262; G05F 3/265; G05F 1/56
USPC ..... 323/312, 282, 283, 285, 265, 273–275, 323/280, 281, 901; 363/49
See application file for complete search history.

(56) References Cited

U.S. PATENT DOCUMENTS

| | | | | |
|---|---|---|---|---|
| 7,265,631 | B2 * | 9/2007 | Kwa et al. | 330/308 |
| 7,508,176 | B2 * | 3/2009 | Hartular et al. | 323/268 |
| 7,619,397 | B2 * | 11/2009 | Al-Shyoukh | 323/281 |
| 7,719,249 | B2 * | 5/2010 | Matyas et al. | 323/285 |
| 7,786,779 | B2 * | 8/2010 | Chang et al. | 327/170 |
| 8,305,066 | B2 * | 11/2012 | Lin et al. | 323/285 |
| 2004/0160270 | A1 | 8/2004 | Tzeng et al. | |
| 2009/0256540 | A1 * | 10/2009 | Yang et al. | 323/282 |

FOREIGN PATENT DOCUMENTS

| | | |
|---|---|---|
| CN | 101674015 A | 3/2010 |
| TW | 200944978 | 11/2009 |

OTHER PUBLICATIONS

D.A. Neaman. "Microelectronics: Circuit Analysis and Design". 2007. McGraw-Hill Companies. 3rd ed. pp. 1193-1194.*
G.A. Rincon-Mora and P.E. Allen. "A Low-Voltage, Low Quiescent Current, Low Drop-Out Regulator". Jan. 1998. IEEE Journal of Solid-State Circuits. vol. 33, No. 1. pp. 36-43.*

(Continued)

*Primary Examiner* — Matthew Nguyen
*Assistant Examiner* — Kevin H Sprenger
(74) *Attorney, Agent, or Firm* — Winston Hsu; Scott Margo

(57) ABSTRACT

A signal generating circuit includes: a first signal amplifying circuit arranged to generate a first amplified signal according to a first supply current, a reference signal, and an output signal of the signal generating circuit; a soft-start circuit arranged to generate a control signal according to a soft-start signal; a current controlled circuit arranged to generate the first supply current according to the soft-start signal; and a pass transistor arranged to generate an output signal according to an error amplified signal and the control signal. The error amplified signal is derived from the first amplified signal.

18 Claims, 5 Drawing Sheets

(56) References Cited

OTHER PUBLICATIONS

M. Al-Shyoukh and H. Lee. "A Compact Ramp-Based Soft-Start Circuit for Voltage Regulators". Jul. 2009. IEEE Transactions on Circuits and Systems-II: Express Briefs. vol. 56, No. 7. pp. 535-539.*

M. Al-Shyoukh and H. Lee. "A Compact Fully-Integrated Extremum-Selector-Based Soft-Start Circuit for Voltage Regulators in Bulk CMOS Technologies." Oct. 2010. IEEE Transactions on Circuits and Systems-II: Express Briefs. vol. 57, No. 10. pp. 818-822.*

* cited by examiner

SIGNAL GENERATING CIRCUIT

BACKGROUND

The present invention relates to a low drop-out regulator, and more particularly to a circuit for speeding up the activation time of a low drop-out regulator.

Low Drop-out Regulator (LDO) is a well-known DC-to-DC voltage regulator. When a circuit system is power on, the LDO should be controlled to enter a soft-start state before entering the normal state, otherwise an inrush current may be induced. The inrush current may decrease a voltage level of a power supply, which supplies power to the LDO, as the power supply may not be able to generate the large inrush current in such a short time. Then, the decreased voltage level may affect the operation of other circuits connected to the power supply. Therefore, conventionally, when the LDO is power up, the LDO is controlled to enter the soft-start state for reducing or eliminating the inrush current. By doing this, however, the activation time of the LDO is longer. More specifically, if the soft-start operation of the LDO is controlled by a soft-start circuit, then the soft-start circuit may limit the supply current of the LDO to limit the inrush current during the soft-start state. If the soft-start circuit decreases the supply current of the LDO during the soft-start state to reduce the inrush current, the activation time of the LDO becomes longer. As the quiescent current of the conventional LDO may decide the activating current of the conventional LDO during the start up period, improving the activation time of the LDO may worsen the power consumption of the LDO by using the conventional ways. Therefore, there is a need to solve the above-mentioned problem by providing a fast activated and low power consumed LDO.

SUMMARY

One of the objectives is to provide a circuit for speeding up the activation time of a low drop-out regulator.

According to a first embodiment of the present invention, a signal generating circuit is provided. The signal generating circuit comprises a first signal amplifying circuit, a soft-start circuit, a current controlled circuit, and a pass transistor. The first signal amplifying circuit is arranged to generate a first amplified signal according to a first supply current, a reference signal, and an output signal of the signal generating circuit. The soft-start circuit is arranged to generate a control signal according to a soft-start signal. The current controlled circuit is arranged to generate the first supply current according to the soft-start signal. The pass transistor is arranged to generate the output signal according to an error amplified signal and the control signal, wherein the error amplified signal is derived from the first amplified signal.

According to a second embodiment of the present invention, a signal generating circuit is provided. The signal generating circuit comprises a first signal amplifying circuit, a second signal amplifying circuit, a soft-start circuit, a current controlled circuit, a pass transistor, and a compensating circuit. The first signal amplifying circuit is arranged to generate a first amplified signal according to a first supply current, a reference signal, and an output signal of the signal generating circuit. The second signal amplifying circuit is arranged to generate a second amplified signal according to a second supply current and the first amplified signal. The soft-start circuit is arranged to generate a control signal according to a soft-start signal. The current controlled circuit is arranged to generate the first supply current and the second supply current according to an enable signal. The pass transistor is arranged to generate the output signal according to the second amplified signal and the control signal. The compensating circuit is coupled between an input terminal of the second signal amplifying circuit and an output terminal of the second signal amplifying circuit. When the enable signal enables the current controlled circuit, the control signal has a first logic level during a predetermined time interval and has a second logic level different from the first logic level when the predetermined time interval is over. The compensating circuit is arranged to provide a first impedance during the predetermined time interval, and to provide a second impedance when the predetermined time interval is over, wherein the first impedance is different from the second impedance.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
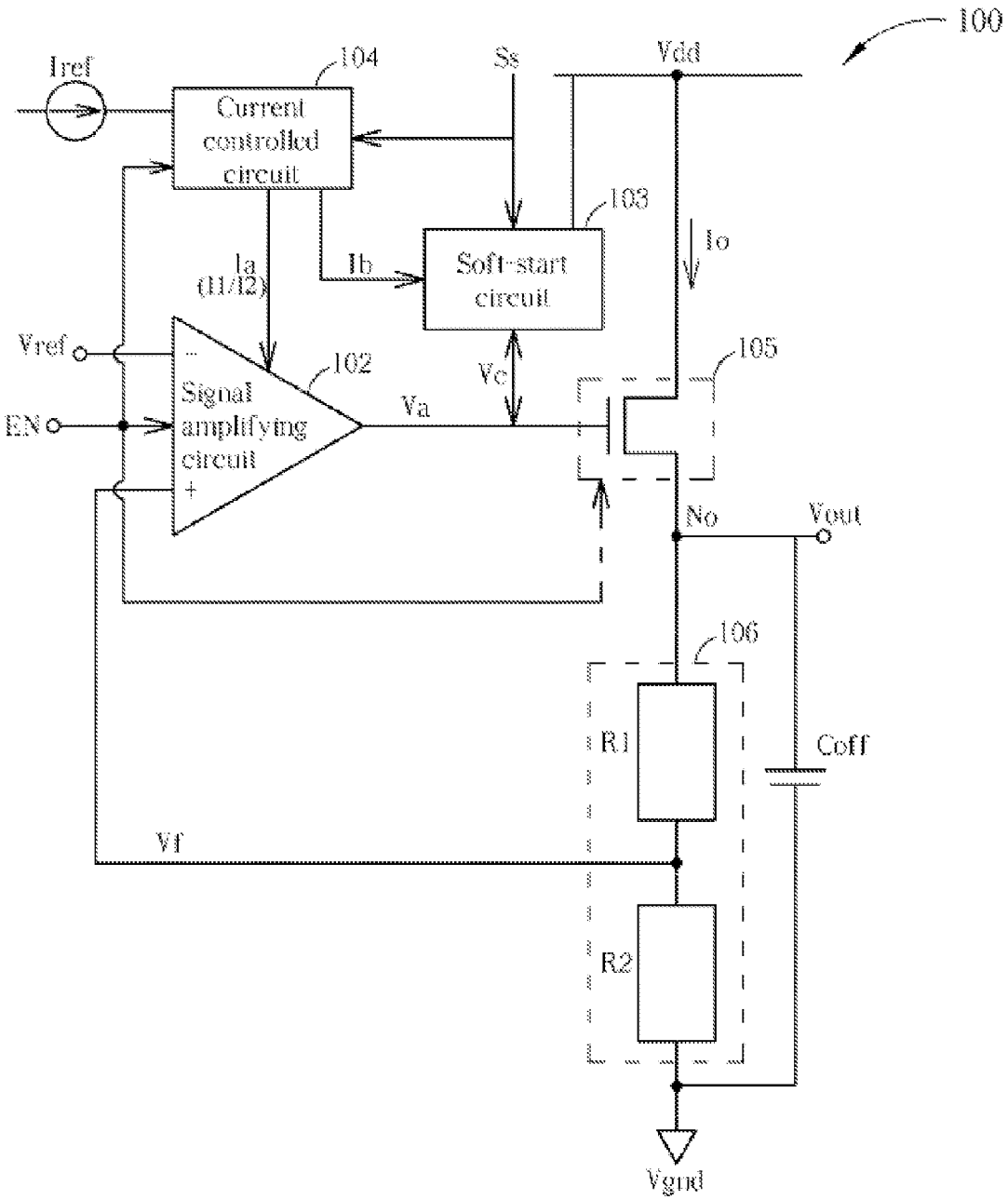
FIG. 1 is a diagram illustrating a signal generating circuit according to a first embodiment of the present invention.

Please refer to FIG. 1, which is a diagram illustrating a signal generating circuit 100 according to a first embodiment of the present invention. The signal generating circuit 100 comprises a signal amplifying circuit 102, a soft-start circuit 103, a current controlled circuit 104, and a pass transistor 105. The signal amplifying circuit 102 is arranged to generate an amplified signal Va according to a supply current la, a reference signal Vref, and an output signal Vout of the signal generating circuit 100. The soft-start circuit 103 is arranged to generate a control signal Vc according to a soft-start signal Ss. The current controlled circuit 104 is arranged to generate the supply current la according to the soft-start signal Ss. The pass transistor 105 is arranged to generate the output signal Vout according to an error amplified signal and the control signal Vc, wherein the error amplified signal is derived from the amplified signal Va. In addition, in this exemplary embodiment, the current controlled circuit 104 is further controlled by an enable signal EN. When the enable signal EN enables the current controlled circuit 104, the soft-start signal Ss controls the current controlled circuit 104 to generate the first predetermined supply current I1 to the signal amplifying circuit 102 during a predetermined time interval Ta, and the soft-start signal Ss also controls the current controlled circuit 104 to generate a second predetermined supply current I2 to the first signal amplifying circuit 102 when the predetermined time interval Ta is over, wherein the first predetermined supply current I1 is different from the second predetermined supply current I2. In addition, the enable signal EN is also arranged to control the enablement of the signal amplifying circuit 102 and the pass transistor 105 as shown in FIG. 1. When the enable signal EN enables the current controlled circuit 104, the enable signal EN also enables the first signal amplifying circuit 102 and the pass transistor 105 at the same time for activating the signal generating circuit 100, and vice versa. In addition, the signal generating circuit 100 further comprises a voltage dividing circuit 106, wherein the voltage dividing circuit 106 receives the output signal Vout to generate a feedback signal Vf to the signal amplifying circuit 102.

More specifically, the signal generating circuit 100 can be applied to implement a low drop-out regulator (LDO), and the output voltage of the LDO can be the output signal Vout. The current controlled circuit 104 receives reference current Iref, and outputs the supply currents Ia, Ib according to the enable signal EN and the soft-start signal Ss, wherein the supply current Ia is provided to the signal amplifying circuit 102, and the supply current Ib is provided to the soft-start circuit 103. The signal amplifying circuit 102 may be an error amplifier, in which the error amplifier has a negative input terminal (−) arranged to receive the reference signal Vref, a positive input terminal (+) arranged to receive the feedback signal Vf, and an output terminal arranged to output the amplified signal Va. The output terminal of the signal amplifying circuit 102 is also coupled to the output terminal of the soft-start circuit 103, wherein the output terminal of the soft-start circuit 103 is used to generate the control signal Vc. The pass transistor 105 may be a P-type field-effected power transistor. A control terminal of the P-type field-effected power transistor is coupled to the output terminal of the signal amplifying circuit 102, and a first connecting terminal of the P-type field-effected power transistor is coupled to the supply voltage Vdd. The voltage dividing circuit 106 comprises a first resistor R1 and a second resistor R2. The first resistor R1 and the second resistor R2 are connected between a second connecting terminal (i.e. the output terminal No) of the P-type field-effected power transistor and the ground voltage Vgnd in series. The feedback signal Vf is fed back to the negative input terminal of the signal amplifying circuit 102 from a common terminal of the first resistor R1 and the second resistor R2. In addition, when the signal generating circuit 100 is under operation, the signal generating circuit 100 may be coupled to a next stage circuit, and the loading of the next stage circuit is briefly represented by an external capacitor Coff, wherein the external capacitor Coff is coupled between the output terminal No and the ground voltage Vgnd as shown in FIG. 1.

Figure 2:
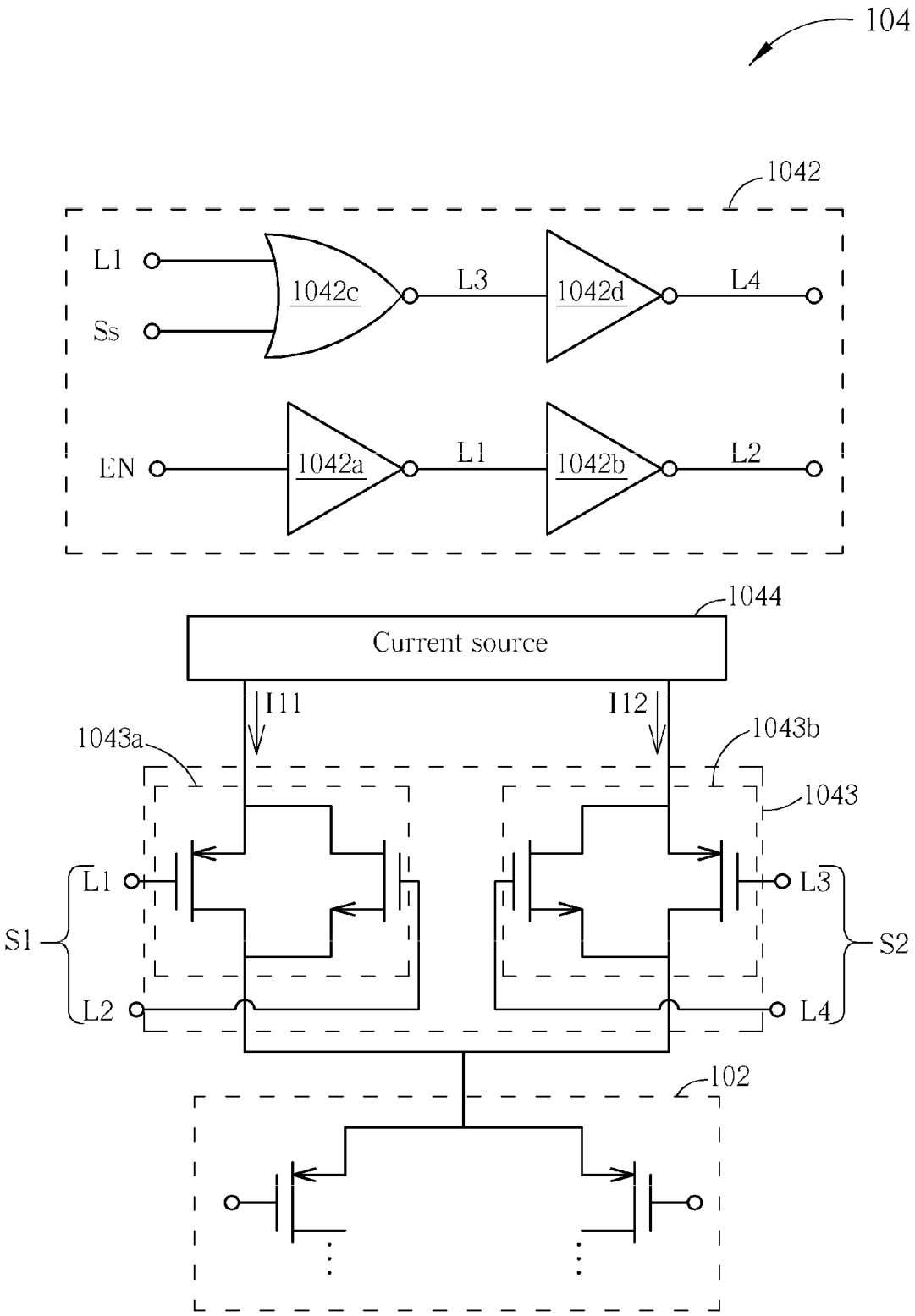
FIG. 2 is a diagram illustrating a current controlled circuit according to an embodiment of the present invention.

Please refer to FIG. 2, which is a diagram illustrating a current controlled circuit 104 according to an embodiment of the present invention. The current controlled circuit 104 comprises a logic circuit 1042 and a switching circuit 1043.

The logic circuit 1042 is arranged to receive the soft-start signal Ss and the enable signal EN to generate a first switch controlling signal S1 and a second switch controlling switch S2. The switching circuit 1043 is coupled between the current source 1044 and the signal amplifying circuit 102, and is arranged to transmit the first current I11 and the second current I12, which are generated by the current source 1044, to the signal amplifying circuit 102 according to the first switch controlling signal S1 and the second switch controlling signal S2, and to stop transmit the second current I12 to the signal amplifying circuit 102 when the predetermined time interval Ta is over.

The logic circuit 1042 comprises a first inverter 1042*a*, a second inverter 1042*b*, a NOR gate 1042*c*, and a third inverter 1042*d*. The first inverter 1042*a* is arranged to perform an inversion upon the enable signal EN to generate the first logic signal L1 . The second inverter 1042*b* is arranged to perform an inversion upon the first logic signal L1 to generate the second logic signal L2, wherein the first logic signal L1 and the second logic signal L2 are configured as the first switch controlling signal S1. The NOR gate 1042*c* is arranged to perform a NOR operation upon the soft-start signal Ss and the first logic signal L1 to generate the third logic signal L3. The third inverter 1042*d* is arranged to perform an inversion upon the third logic signal L3 to generate the fourth logic signal L4, wherein the third logic signal L3 and the fourth logic signal L4 are configured as the second switch controlling signal S2.

In addition, the switching circuit 1043 comprises a first switch 1043*a* and a second switch 1043*b*. The first switch 1043*a* is coupled between the current source 1044 and the signal amplifying circuit 102, and is arranged to transmit the first current I11 to the signal amplifying circuit 102 according to the first switch controlling signal S1. The second switch 1043*b* is coupled between the current source 1044 and the signal amplifying circuit 102, and is arranged to transmit the second current I12 to the signal amplifying circuit 102 during the predetermined time interval Ta according to the second switch controlling signal S2. The second switch 1043*b* stop transmits the second current I12 to the signal amplifying circuit 102 when the predetermined time interval Ta is over. In this exemplary embodiment, the first switch 1043*a* may be comprised of a P-type field-effected transistor (FET) and an N-type FET, wherein the P-type FET is connected to the N-type FET in parallel, and the first logic signal L1 and the second logic signal L2 are coupled to the gate terminals of the P-type FET and the N-type FET respectively. Moreover, the second switch 1043*b* may also be comprised of a P-type FET and an N-type FET, wherein the P-type FET is connected to the N-type FET in parallel, and the third logic signal L3 and the fourth logic signal L4 are coupled to the gate terminals of the P-type FET and the N-type FET respectively as shown in FIG. 2. It is noted that the signal amplifying circuit 102 is briefly illustrated by a differential transistor pair in FIG. 2, however, the present invention is not limited to the configuration of FIG. 2.

Figure 3:
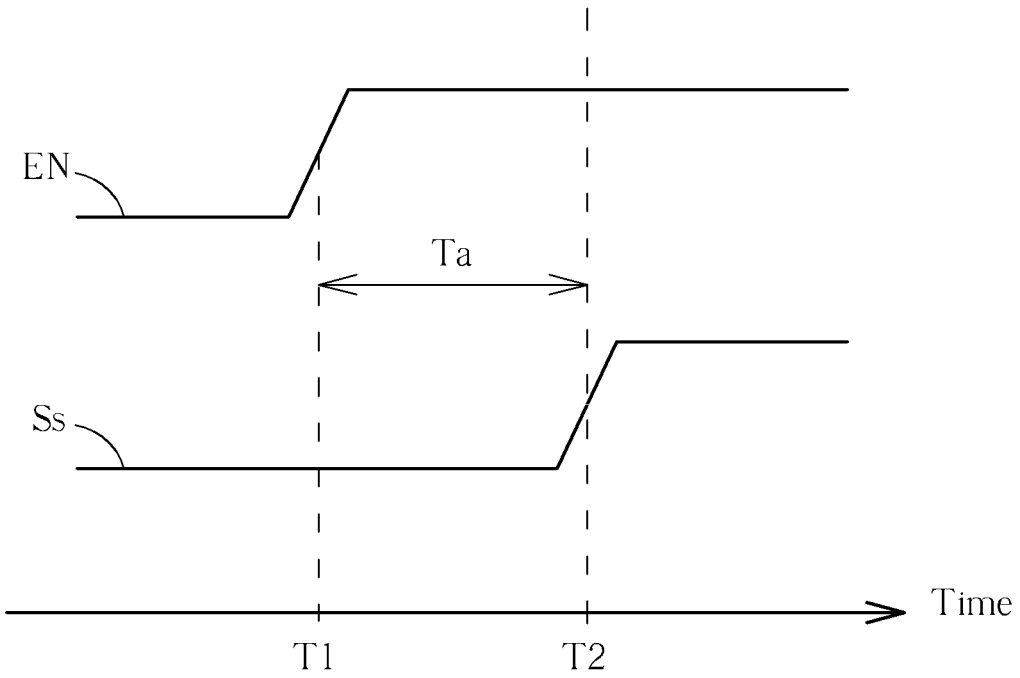
FIG. 3 is a timing diagram illustrating an enable signal and a soft-start signal of a signal generating circuit according to an embodiment of the present invention.

Please refer to FIG. 3, which is a timing diagram illustrating the enable signal EN and the soft-start signal Ss of the signal generating circuit 100 according to an embodiment of the present invention. When the enable signal EN starts to enable the signal amplifying circuit 102, the current controlled circuit 104, and the pass transistor 105 at time T1, the logic level of the enable signal EN is converted to a high logic level from a low logic level, and the logic level of the soft-start signal Ss is kept on the low logic level. Accordingly, the first logic signal L1 and the second logic signal L2 turn on (i.e. close) the P-type FET and the N-type FET of the first switch 1043*a* respectively to transmit the first current I11 to the signal amplifying circuit 102. Meanwhile, the third logic signal L3 and the fourth logic signal L4 also turn on the P-type FET and the N-type FET of the second switch 1043*b* respectively to transmit the second current I12 to the signal amplifying circuit 102. Therefore, during the predetermined time interval Ta after the signal generating circuit 100 is activated, i.e. during the so-called soft-start interval, the operating current of the signal amplifying circuit 102 is the total current (i.e. the first predetermined supply current I1) of the first current I11 and the second current I12. If the pass transistor 105 is a P-type field-effected power transistor, the low logic level of the soft-start signal Ss controls the soft-start circuit 103 to increase the voltage level at the control terminal of the pass transistor 105 into a predetermined voltage level at time T1, and consequently decreases the maximum current flowing through the P-type field-effected power transistor. On the contrary, if the pass transistor 105 is an N-type field-effected power transistor, the low logic level of the soft-start signal Ss controls the soft-start circuit 103 to decrease the voltage level at the control terminal of the pass transistor 105 into a predetermined voltage level at time T1, and consequently decreases the maximum current flowing through the N-type field-effected power transistor.

Then, when the logic level of the soft-start signal Ss is converted to the high logic level from the low logic level at time T2, the first logic signal L1 and the second logic signal L2 will still turn on the P-type FET and the N-type FET of the first switch 1043*a* to continue transmitting the first current I11 to the signal amplifying circuit 102, and the third logic signal L3 and the fourth logic signal L4 turn off (i.e. open) the P-type FET and the N-type FET respectively to stop transmit the second current I12 to the signal amplifying circuit 102. Therefore, after the predetermined time interval Ta, only the first current I11 (i.e. the second predetermined supply current I2) is supplied to the signal amplifying circuit 102. On the other hand, at time T2, the high logic level of the soft-start signal Ss controls the soft-start circuit 103 to stop adjust the control terminal of the pass transistor 105 such that the pass transistor 105 can generate the output signal Vout according to the amplified signal Va generated by the signal amplifying circuit 102

In other words, after the signal generating circuit 100 is activated, the signal amplifying circuit 102 is operated under the first predetermined supply current I1 during the predetermined time interval Ta, and the signal amplifying circuit 102 is operated under the second predetermined supply current I2 when the predetermined time interval Ta is over, wherein the first predetermined supply current I1 is larger than the second predetermined supply current I2. Therefore, the second predetermined supply current I2 (i.e. the first current I11) can be regarded as the quiescent DC current of the signal amplifying circuit 102. Moreover, during the soft-start procedure (i.e. during the predetermined time interval Ta), the maximum steady output current of the pass transistor 105 is dependent on the control signal Vc of the soft-start circuit 103, and the operating current (i.e. the supply current Ia) of the signal amplifying circuit 102 is only controlled by the current controlled circuit 104. In other words, by appropriately modifying the embodiment, the maximum steady output current Io of the pass transistor 105 is not affected by the amplified signal Va of the signal amplifying circuit 102 during the soft-start procedure.

According to the above description related to the signal generating circuit 100, during the predetermined time interval Ta after the signal generating circuit 100 is activated, the supply current of the signal amplifying circuit 102 is larger than its supply current operated under the normal operation (i.e. after the time T2), and the maximum current Io flowing through the pass transistor 105 is smaller than the maximum current flowing through the pass transistor 105 when the pass transistor 105 is operated under the normal operation. Therefore, the response of the signal amplifying circuit 102 is faster during the predetermined time interval Ta, which means that the bandwidth of the signal amplifying circuit 102 is wider during the predetermined time interval Ta. It is noted that, the overshoot current of the pass transistor 105 can also be suppressed during the predetermined time interval Ta. In other words, the signal generating circuit 100 has a faster settle time after the activation (i.e. the signal generating circuit 100 is faster to enter a steady locked state) meanwhile the overshoot current is suppressed. It is noted that the overshoot current is the current flowing to the output terminal No from the supply voltage Vdd when the signal generating circuit 100 is activated at time T1. Moreover, since the quiescent DC current of the signal amplifying circuit 102 can be adjusted to the smaller second predetermined supply current I2 during the normal operation (i.e. after the time T2) of the signal generating circuit 100, the power consumption of the signal generating circuit 100 is lower than the conventional counterpart.

Figure 4:
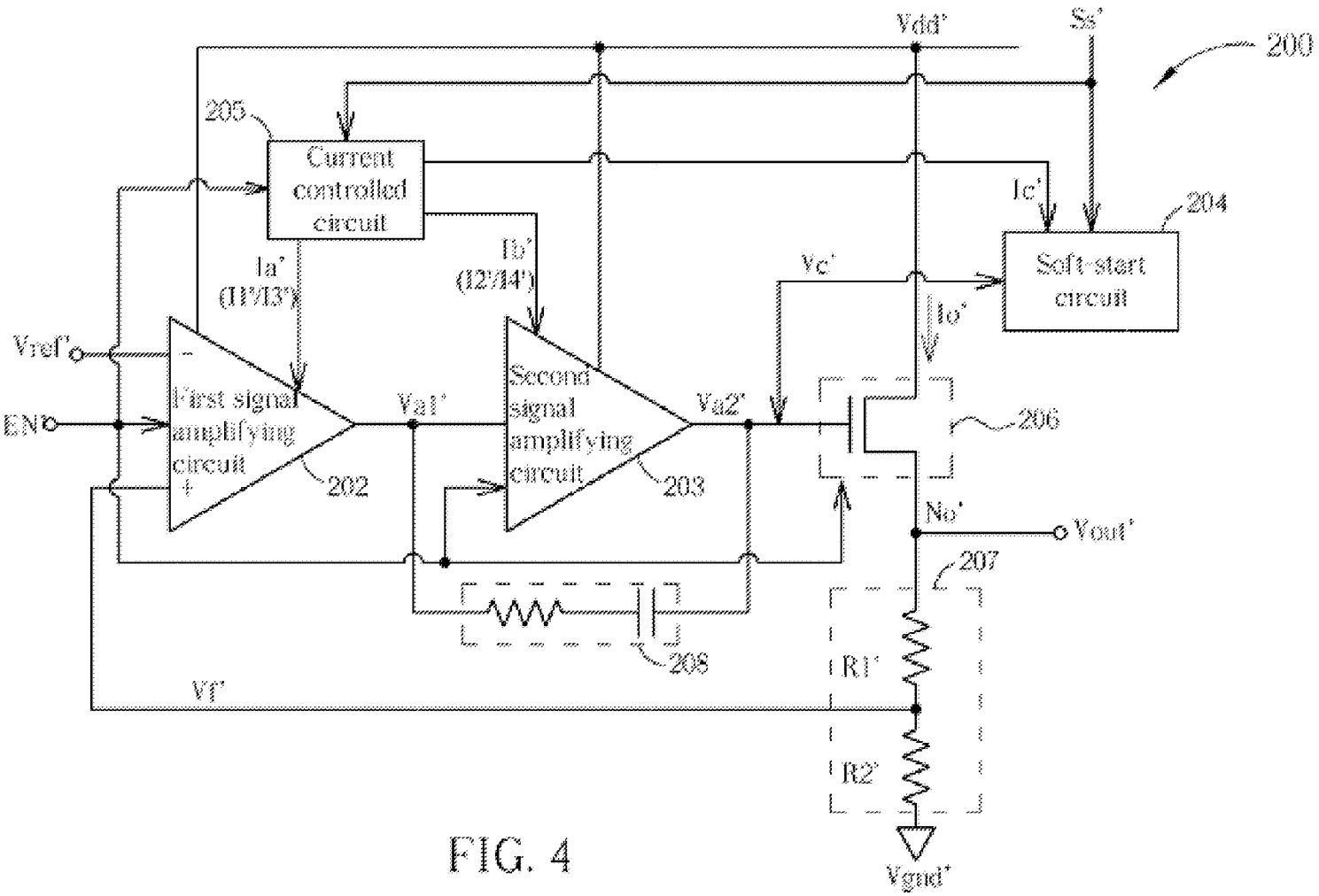
FIG. 4 is a diagram illustrating a signal generating circuit according to a second embodiment of the present invention.

Please refer to FIG. 4, which is a diagram illustrating a signal generating circuit 200 according to a second embodiment of the present invention. The signal generating circuit 200 comprises a first signal amplifying circuit 202, a second signal amplifying circuit 203, a soft-start circuit 204, a current controlled circuit 205, a pass transistor 206, and a voltage dividing circuit 207. The first signal amplifying circuit 202 is arranged to generate a first amplified signal Va1' according to a first supply current Ia', a reference signal Vref', and an output signal Vout' of the signal generating circuit 200. The second signal amplifying circuit 203 is coupled between the first signal amplifying circuit 202 and the pass transistor 206, and is arranged to generate a second amplified signal Va2' according to a second supply current Ib' and the first amplified signal Va1', wherein the second amplified signal Va2' may represent the error amplified signal of the reference signal Vref' and the feedback signal Vf'. The soft-start circuit 204 is arranged to generate a control signal Vc' according to a soft-start signal Ss'. The current controlled circuit 205 is arranged to generate the first supply current Ia' and the second supply current Ib' according to the soft-start signal Ss'. The pass transistor 206 is arranged to generate the output signal Vout' according to the above error amplified signal (i.e. the second amplified signal Va2') and the control signal Vc'. In addition, in this exemplary embodiment, the current controlled circuit 205 is further controlled by an enable signal EN', and when the enable signal EN' enables the current controlled circuit 205, the soft-start signal Ss' controls the current controlled circuit 205 to generate the first predetermined supply current I1' and the second predetermined supply current I2' to the first signal amplifying circuit 202 and the second signal amplifying circuit 203 respectively during a predetermined time interval Ta'. The soft-start signal Ss' also controls the current controlled circuit 205 to generate a third predetermined supply current I3' and a fourth predetermined supply current I4' to the first signal amplifying circuit 202 and the second signal amplifying circuit 203 respectively when the predetermined time interval Ta' is over, wherein the first predetermined supply current I1' is different from the third predetermined supply current I3', and the second predetermined supply current I2' is different from the fourth predetermined supply current I4'. In addition, the enable signal EN' is also arranged to control the enablement of the first signal amplifying circuit 202, the second signal amplifying circuit 203, and the pass transistor 206 as shown in FIG. 4. When the enable signal EN' enables the current controlled circuit 205, the enable signal EN' also enables the first signal amplifying circuit 202, the second signal amplifying circuit 203, and the pass transistor 206 at the same time to activate the signal generating circuit 200, and vice versa. In addition, the voltage dividing circuit 207 is arranged to perform voltage dividing upon the output signal Vout' to generate a feedback signal Vf' to the first signal amplifying circuit 202. In this exemplary embodiment, the signal generating circuit 200 further comprises a compensating circuit 208, which is coupled between an input terminal of the second signal amplifying circuit 202 and an output terminal of the second signal amplifying circuit 203.

More specifically, the signal generating circuit 200 may be a low drop-out regulator, and the output voltage of the low drop-out regulator can be the output signal Vout' . The current controlled circuit 205 is arranged to output the supply currents Ia', Ib', Ic' according to the enable signal EN' and the soft-start signal Ss', wherein the supply current Ia' is supplied to the first signal amplifying circuit 202, the supply current Ib' is supplied to the second signal amplifying circuit 203, and the supply current Ic' is supplied to the soft-start circuit 204. The first signal amplifying circuit 202 may be an error amplifier, and the negative input terminal (−) is arranged to receive the reference signal Vref', the positive input terminal (+) is arranged to receive the feedback signal Vf', and the output terminal is arranged to output the first amplified signal Va1'. The second signal amplifying circuit 203 is arranged to amplify the first amplified signal Val' to generate the second amplified signal Va2' at the output terminal. The output terminal of the second signal amplifying circuit 203 is further coupled to the output terminal (i.e. the control signal Vc') of the soft-start circuit 204. The pass transistor 206 may be a P-type field-effected power transistor, which has a controlling terminal coupled to the output terminal of the second signal amplifying circuit 203, and a first connecting terminal coupled to the supply voltage Vdd'. The voltage dividing circuit 207 comprises a first resistor R1' and a second resistor R2'. The first resistor R1' and the second resistor R2' are connected between the second connecting terminal (i.e. the output terminal No') of the P-type field-effected power transistor and the ground voltage Vgnd' in series. The feedback signal Vf' is fed back to the negative input terminal of the first signal amplifying circuit 202 from a common terminal of the first resistor R1' and the second resistor R2'.

The signal generating circuit 200 further comprises a second signal amplifying circuit 203. It is noted that the current control method performed upon the first signal amplifying circuit 202 by the current controlled circuit 205 is similar to the current control method performed upon the signal amplifying circuit 102 by the current controlled circuit 104, and the current control method performed upon the second signal amplifying circuit 203 by the current controlled circuit 205 is similar to the current control method performed upon the signal amplifying circuit 102 by the current controlled circuit 104. Therefore, the detailed structure of the current controlled circuit 205 and the signal timing of the signal generating circuit 200 can be referred to the FIG. 2 and FIG. 3, and the detailed description is omitted here for brevity.

When the enable signal EN' (i.e. the enable signal EN in FIG. 3) starts to enable the first signal amplifying circuit 202, the second signal amplifying circuit 203, the current controlled circuit 205, and the pass transistor 206 at time T1, the logic level of the enable signal EN' is converted to the high logic level from the low logic level, and the logic level of the soft-start signal Ss' (i.e. the soft-start signal Ss in FIG. 3) is kept on the low logic level. During the predetermined time interval Ta after the signal generating circuit 200 is activated (i.e. during the soft-start procedure), the first signal amplifying circuit 202 is operated under the first predetermined supply current I1', and the second signal amplifying circuit 203 is operated under the second predetermined supply current I2'. In addition, if the pass transistor 206 is a P-type field-effected power transistor, then, at time T1, the low logic level of the soft-start signal Ss' controls the soft-start circuit 204 to increase the voltage level at the controlling terminal of the pass transistor 206 by a predetermined voltage level to thereby reduce the maximum current flowing through the P-type field-effected power transistor. On the contrary, if the pass transistor 206 is an N-type field-effected power transistor, then, at time T1, the low logic level of the soft-start signal Ss' controls the soft-start circuit 204 to decrease the voltage level at the controlling terminal of the pass transistor 206 by a predetermined voltage level to thereby reduce the maximum current flowing through the N-type field-effected power transistor.

Then, when the logic level of the soft-start signal Ss' is converted to the high logic level from the low logic level at time T2, the first signal amplifying circuit 202 is operated under the third predetermined supply current I3', and the second signal amplifying circuit 203 is operated under the fourth predetermined supply current I4'. In addition, at time T2, the high logic level of the soft-start signal Ss' controls the soft-start circuit 204 to stop control the controlling terminal of the pass transistor 206. Therefore, the pass transistor 206 can refer the second amplified signal Va2' generated by the second signal amplifying circuit 203 to generate the output signal Vout' after time T2.

Moreover, during the predetermined time interval Ta after the signal generating circuit 200 is activated, the first signal amplifying circuit 202 and the second signal amplifying circuit 203 are operated under the first predetermined supply current I1' and the second predetermined supply current I2' respectively, and the first signal amplifying circuit 202 and the second signal amplifying circuit 203 are operated under the third predetermined supply current I3' and the fourth predetermined supply current I4' respectively when the predetermined time interval Ta is over, wherein the first predetermined supply current I1' and the second predetermined supply current I2' are larger than the third predetermined supply current I3' and the fourth predetermined supply current I4' respectively. Therefore, the third predetermined supply current I3' and the fourth supply current I4' can also be regarded as the quiescent DC currents of the first signal amplifying circuit 202 and the second signal amplifying circuit 203 respectively. In addition, during the soft-start procedure (i.e. during the predetermined time interval Ta), the maximum steady output current of the pass transistor 206 is only controlled by the control signal Vc' of the soft-start circuit 204, and the operating currents (i.e., the first supply current Ia' and the second supply current Ib') of the first signal amplifying circuit 202 and the second signal amplifying circuit 203 respectively are only controlled by the current controlled circuit 205. In other words, by appropriately modifying the embodiment, the maximum steady output current Io' of the pass transistor 206 is not affected by the second amplified signal Va2' of the second signal amplifying circuit 203 during the soft-start procedure.

According to the above description related to the signal generating circuit 200, during the predetermined time interval Ta after the signal generating circuit 200 is activated, the supply currents of the first signal amplifying circuit 202 and the second signal amplifying circuit 203 are larger than their normal supply currents when the signal generating circuit 200 is operated under the normal operation (i.e. after the time T2), and the maximum current Io' flowing through the pass transistor 206 is smaller than the maximum current of the pass transistor 206 operated under normal operation. Therefore, the first signal amplifying circuit 202 and the second signal amplifying circuit 203 each have a fast response time during the predetermined time interval Ta, which means that the bandwidths of the first signal amplifying circuit 202 and the second signal amplifying circuit 203 are wider. In addition, the overshoot current of the pass transistor 206 can also be suppressed. In other words, the signal generating circuit 200 has a faster settle time after the activation (i.e. the signal generating circuit 200 is faster to enter a steady locked state) meanwhile the overshoot current is suppressed. Moreover, since the quiescent DC currents of the first signal amplifying circuit 202 and the second signal amplifying circuit 203 can be adjusted to the smaller third predetermined supply current I3' and the fourth predetermined supply current 14' respectively during the normal operation (i.e. after the time T2) of the signal generating circuit 200, the power consumption of the signal generating circuit 200 is lower than the conventional counterpart.

Figure 5:
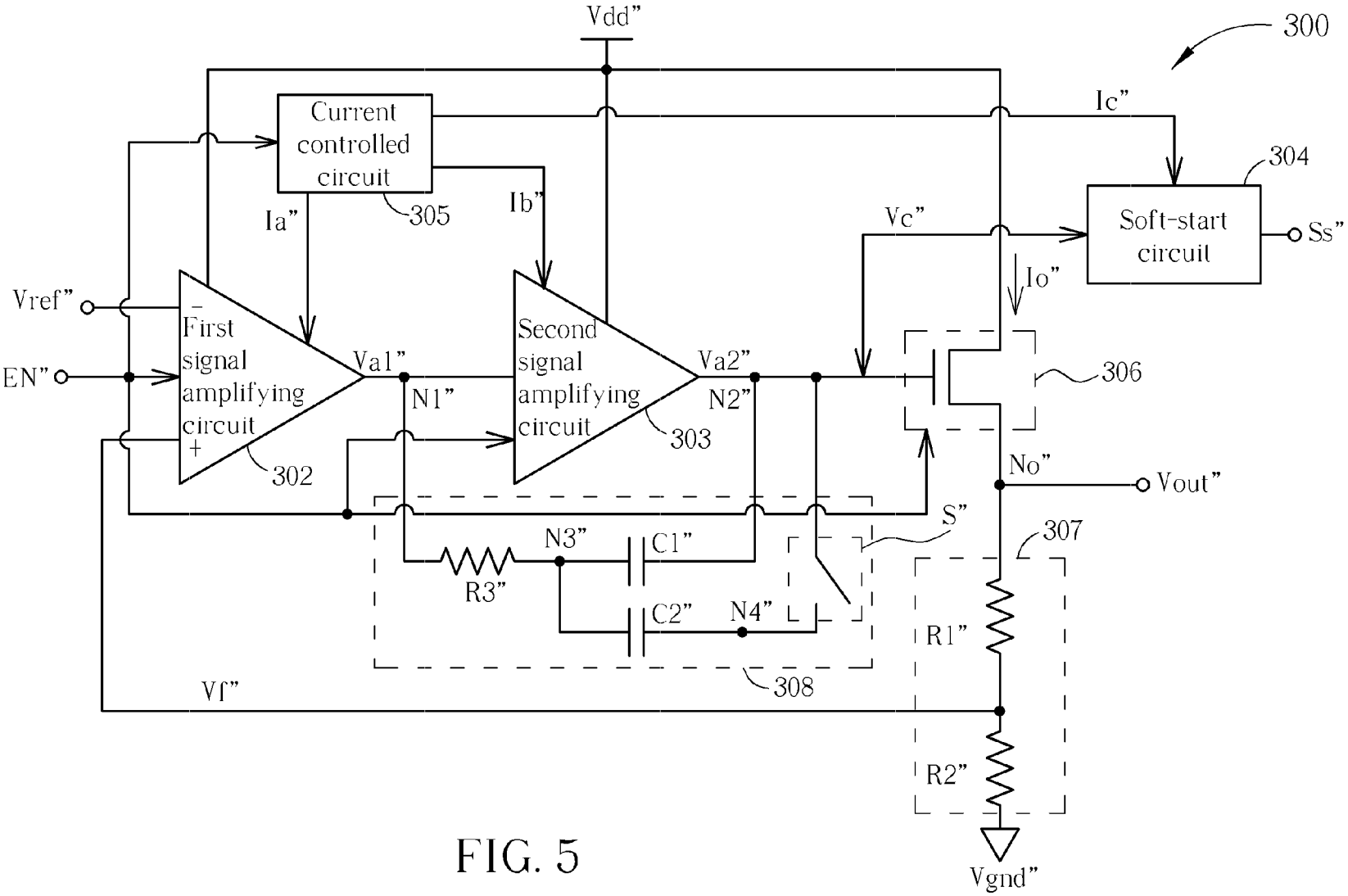
FIG. 5 is a diagram illustrating a signal generating circuit according to a third embodiment of the present invention.

Please refer to FIG. 5, which is a diagram illustrating a signal generating circuit 300 according to a third embodiment of the present invention. The signal generating circuit 300 comprises a first signal amplifying circuit 302, a second signal amplifying circuit 303, a soft-start circuit 304, a current controlled circuit 305, a pass transistor 306, a voltage dividing circuit 307, and a compensating circuit 308. The first signal amplifying circuit 302 is arranged to generate a first amplified signal Va1" according to a first supply current Ia", a reference signal Vref", and an output signal Vout" of the signal generating circuit 300. The second signal amplifying circuit 303 is coupled between the first signal amplifying circuit 302 and the pass transistor 306, and is arranged to generate a second amplified signal Va2" according to a second supply current Ib" and the first amplified signal Va1", wherein the second amplified signal Va2" may represent the error amplified signal of the reference signal Vref" and the feedback signal Vf". The soft-start circuit 304 is arranged to generate a control signal Vc" according to a soft-start signal Ss". The pass transistor 306 is arranged to generate the output signal Vout" according to the above error amplified signal (i.e. the second amplified signal Va2") and the control signal Vc". In addition, in this exemplary embodiment, the current controlled circuit 305 is further controlled by an enable signal EN". When the enable signal EN" enables the current controlled circuit 305, the current controlled circuit 305 generates the first supply current Ia" and the second supply current Ib" to the first signal amplifying circuit 302 and the second signal amplifying circuit 303 respectively. In addition, the enable signal EN" is also arranged to control the enablement of the first signal amplifying circuit 302, the second signal amplifying circuit 303, and the pass transistor 306 as shown in FIG. 5. When the enable signal EN" enables the current controlled circuit 305, the enable signal EN" also enables the first signal amplifying circuit 302, the second signal amplifying circuit 303, and the pass transistor 306 at the same time to activate the signal generating circuit 300, and vice versa. In addition, the voltage dividing circuit 307 is arranged to perform voltage dividing upon the output signal Vout" to generate a feedback signal Vf" to the first signal amplifying circuit 302.

In this exemplary embodiment, the compensating circuit 308 of the signal generating circuit 300 is coupled between an input terminal N1" of the second signal amplifying circuit 302 and an output terminal N2" of the second signal amplifying circuit 303. The compensating circuit 308 is utilized to provide a first impedance during a predetermined time interval Ta, and provide a second impedance when the predetermined time interval Ta is over, wherein the first impedance different from the second impedance. In this exemplary embodiment, the first impedance is greater than the second impedance.

In addition, in this exemplary embodiment, the compensating circuit 308 comprises a resistor R3", a first capacitor C1", a second capacitor C2", and a switch S". The resistor R3" and the first capacitor C1" are connected between the input terminal N1" and the output terminal N2" in series. One terminal of the second capacitor C2" is coupled to terminal N3", and the other terminal of the second capacitor C2" is coupled to the terminal N4" of the switch S". The other terminal of the switch S" is coupled to output terminal N2".

Please refer to FIG. 3 again. When the enable signal EN" (i.e. the enable signal EN in FIG. 3) starts to enable the first signal amplifying circuit 302, the second signal amplifying circuit 303, the current controlled circuit 305, and the pass transistor 306 at time T1, the logic level of the enable signal EN" is converted to the high logic level from the low logic level, and the logic level of the soft-start signal Ss" (i.e. the soft-start signal Ss in FIG. 3) is kept on the low logic level. When the signal generating circuit 300 is activated, the first signal amplifying circuit 302 is operated under the first supply current Ia", and the second signal amplifying circuit 303 is operated under the second supply current Ib". In addition, if the pass transistor 306 is a P-type field-effected power transistor, then, at time T1, the low logic level of the soft-start signal Ss" controls the soft-start circuit 304 to increase the voltage level at the controlling terminal of the pass transistor 306 by a predetermined voltage level to thereby reduce the maximum current flowing through the P-type field-effected power transistor. On the contrary, if the pass transistor 306 is an N-type field-effected power transistor, then, at time T1, the low logic level of the soft-start signal Ss" controls the soft-start circuit 304 to decrease the voltage level at the controlling terminal of the pass transistor 306 by a predetermined voltage level to thereby reduce the maximum current flowing through the N-type field-effected power transistor. Meanwhile, the enable signal EN" turns off the switch S" at time T1 to open the path between the second capacitor C2" and the output terminal N2".

Then, when the logic level of the soft-start signal Ss" is converted to the high logic level from the low logic level at time T2, the first signal amplifying circuit 302 is operated under the first supply current Ia", and the second signal amplifying circuit 303 is operated under the second supply current Ib". In addition, at time T2, the high logic level of the soft-start signal Ss" controls the soft-start circuit 304 to stop control the controlling terminal of the pass transistor 306. Therefore, the pass transistor 306 can refer the second amplified signal Va2" generated by the second signal amplifying circuit 303 to generate the output signal Vout" after time T2. Meanwhile, the soft-start signal Ss" turns on the switch S" to connect the terminal N4" of the second capacitor C2" with the output terminal N2" at time T2. In addition, during the soft-start procedure (i.e. during the predetermined time interval Ta), the maximum steady output current of the pass transistor 306 is only controlled by the control signal Vc" of the soft-start circuit 304, and the operating currents (i.e., the first supply current Ia" and the second supply current Ib") of the first signal amplifying circuit 302 and the second signal amplifying circuit 303 respectively are only controlled by the current controlled circuit 305. In other words, by appropriately modifying the embodiment, the maximum steady output current Io" of the pass transistor 306 is not affected by the second amplified signal Va2" of the second signal amplifying circuit 303 during the soft-start procedure.

According to the above description related to the signal generating circuit 300, when the signal generating circuit 300 is activated, the supply currents of the first signal amplifying circuit 302 and the second signal amplifying circuit 303 are kept on the first supply current Ia" and the second supply current Ib" (i.e. their quiescent DC currents) respectively. Moreover, during the predetermined time interval Ta, the capacitance of the compensating circuit 308 between the input terminal N1" and the output terminal N2" is smaller than its normal capacitance when the signal generating circuit 300 is operated under the normal operation (i.e. after the time T2). In other words, during the predetermined time interval Ta, the feedback impedance provided by the compensating circuit 308 is greater than its feedback impedance provided under normal operation. Therefore, the signal generating circuit 300 has larger bandwidth during the predetermined time interval Ta. In other words, as the slew rate of the signal generating circuit 300 is faster during the predetermined time interval Ta, the signal generating circuit 300 can be locked to a steady state in faster. In addition, by adjusting the voltage level at the controlling terminal of the pass transistor 306, the overshoot current of the pass transistor 306 can be suppressed after the activation. Therefore, the present signal generating circuit 300 has fast settle time (i.e. the time entering the steady locked state) and excellent overshoot current controlling ability.

Although the feedback impedance of the signal generating circuit 300 is increased by adjusting the capacitance of the compensating circuit 308, this is not a limitation of the present invention. In another embodiment, the feedback impedance can also be increased by adjusting the resistance of the compensating circuit 308. Those skilled in the art are appreciated to understand how to increase the feedback impedance in the modified embodiment after reading the present exemplary embodiment, thus the detailed embodiment is omitted here for brevity. Briefly, the method of increasing the feedback impedance by adjusting the resistance of the compensating circuit 308 may require chip area larger than the method of adjusting the capacitance of the compensating circuit 308.

In addition, although the signal generating circuit 200 and the signal generating circuit 300 use different controlling method to speed up the time for entering the steady state, both methods can be integrated into a single signal generating circuit. In other words, the combined method also belongs to the scope of the present invention.

Briefly, during the soft-start procedure after the signal generating circuit is activated, the signal generating circuit is controlled to increase the bandwidth to speed up the time for entering the steady state while the pass transistor is controlled to suppress the overshoot current. Accordingly, the present signal generating circuit has fast settle time and excellent overshoot current controlling ability after the signal generating circuit is activated.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A signal generating circuit, comprising:

a first signal amplifying circuit, arranged to generate a first amplified signal according to a first supply current, a reference signal, and an output signal of the signal generating circuit;

a soft-start circuit, arranged to generate a control signal according to a soft-start signal;

a current controlled circuit, arranged to generate the first supply current to the first signal amplifying circuit according to the soft-start signal; and a pass transistor, arranged to generate the output signal according to an error amplified signal and the control signal, wherein the error amplified signal is derived from the first amplified signal.

2. The signal generating circuit of claim 1, wherein the current controlled circuit is further controlled by an enable signal, when the enable signal enables the current controlled circuit, the soft-start signal controls the current controlled circuit to generate a first predetermined supply current to the first signal amplifying circuit during a predetermined time interval, and the soft-start signal further controls the current controlled circuit to generate a second predetermined supply current to the first signal amplifying circuit when the predetermined time interval is over, wherein the first predetermined supply current is different from the second predetermined supply current.

3. The signal generating circuit of claim 2, wherein the first predetermined supply current is greater than the second predetermined supply current.

4. The signal generating circuit of claim 2, wherein the current controlled circuit comprises:

a logic circuit, arranged to receive the soft-start signal and the enable signal to generate a first switch controlling signal and a second switch controlling signal; and a switching circuit, coupled between a current source and the first signal amplifying circuit, and arranged to transmit a first current and a second current generated by the current source to the first signal amplifying circuit according to the first switch controlling signal and the second switch controlling signal, and stop transmit the second current to the first signal amplifying circuit when the predetermined time interval is over.

5. The signal generating circuit of claim 4, wherein a summation of the first current and the second current substantially equals the first predetermined supply current.

6. The signal generating circuit of claim 4, wherein the first current substantially equals the second predetermined supply current.

7. The signal generating circuit of claim 4, wherein the logic circuit comprises:

a first inverter, arranged to perform an inversion upon the enable signal to generate a first logic signal;

a second inverter, arranged to perform an inversion upon the first logic signal to generate a second logic signal, wherein the first logic signal and the second logic signal are configured as the first switch controlling signal;

a NOR gate, arranged to perform a NOR operation upon the soft-start signal and the first logic signal to generate a third logic signal; and a third inverter, arranged to perform an inversion upon the third logic signal to generate a fourth logic signal, wherein the third logic signal and the fourth logic signal are configured as the second switch controlling signal.

8. The signal generating circuit of claim 4, wherein the switching circuit comprises:

a first switch, coupled between the current source and the first signal amplifying circuit, and arranged to transmit the first current to the first signal amplifying circuit according to the first switch controlling signal; and a second switch, coupled between the current source and the first signal amplifying circuit, and arranged to transmit the second current to the first signal amplifying circuit according to the second switch controlling signal during the predetermined time interval, and stop transmit the second current to the first signal amplifying circuit when the predetermined time interval is over.

9. A signal generating circuit, comprising:

a first signal amplifying circuit, arranged to generate a first amplified signal according to a first supply current, a reference signal, and an output signal of the signal generating circuit;

a soft-start circuit, arranged to generate a control signal according to a soft-start signal;

a current controlled circuit, arranged to generate the first supply current according to the soft-start signal; and a pass transistor, arranged to generate the output signal according to an error amplified signal and the control signal, wherein the error amplified signal is derived from the first amplified signal;

wherein the current controlled circuit further generates a second supply current for a second signal amplifying circuit according to the soft-start signal, and the signal generating circuit further comprises:

said second signal amplifying circuit, coupled between the first signal amplifying circuit and the pass transistor, and arranged to generate a second amplified signal to be the error amplified signal according to the second supply current and the first amplified signal.

10. The signal generating circuit of claim 9, wherein the current controlled circuit is further controlled by an enable signal, when the enable signal enables the current controlled circuit, the soft-start signal controls the current controlled circuit to generate a first predetermined supply current for the second signal amplifying circuit during a predetermined time interval, the soft-start signal further controls the current controlled circuit to generate a second predetermined supply current to the second signal amplifying circuit when the predetermined time interval is over, and the first predetermined supply current is different from the second predetermined supply current.

11. The signal generating circuit of claim 10, further comprising:

a compensating circuit, coupled between an input terminal of the second signal amplifying circuit and an output terminal of the second signal amplifying circuit, and arranged to provide a first impedance during the predetermined time interval, and to provide a second impedance when the predetermined time interval is over, wherein the first impedance is different from the second impedance.

12. The signal generating circuit of claim 11, wherein the first impedance is greater than the second impedance.

13. The signal generating circuit of claim 11, wherein the compensating circuit comprises a capacitor.

14. The signal generating circuit of claim 11, wherein the compensating circuit comprises a resistor.

15. A signal generating circuit, comprising:

a first signal amplifying circuit, arranged to generate a first amplified signal according to a first supply current, a reference signal, and an output signal of the signal generating circuit;

a second signal amplifying circuit, arranged to generate a second amplified signal according to a second supply current and the first amplified signal;

a soft-start circuit, arranged to generate a control signal according to a soft-start signal;

a current controlled circuit, arranged to generate the first supply current and the second supply current according to an enable signal;

a pass transistor, arranged to generate the output signal according to the second amplified signal and the control signal; and a compensating circuit, coupled between an input terminal of the second signal amplifying circuit and an output terminal of the second signal amplifying circuit;

wherein when the enable signal enables the current controlled circuit, the control signal has a first logic level during a predetermined time interval, the control signal has a second logic level different from the first logic level when the predetermined time interval is over, and the compensating circuit is arranged to provide a first impedance during the predetermined time interval and to provide a second impedance when the predetermined time interval is over, wherein the first impedance is different from the second impedance.

16. The signal generating circuit of claim 15, wherein the first impedance is greater than the second impedance.

17. The signal generating circuit of claim 15, wherein the compensating circuit comprises a capacitor.

18. The signal generating circuit of claim 15, wherein the compensating circuit comprises a resistor.

* * * * *